US010822991B2

(12) United States Patent
Clarke et al.

(10) Patent No.: US 10,822,991 B2
(45) Date of Patent: Nov. 3, 2020

(54) METHOD AND APPARATUS FOR ACTIVE CLEARANCE CONTROL ON GAS TURBINE ENGINES

(71) Applicant: GENERAL ELECTRIC COMPANY, Schenectady, NY (US)

(72) Inventors: Brandon Christopher Clarke, Hebron, TX (US); Daniel Jean-Louis Laborie, West Chester, OH (US)

(73) Assignee: General Electric Company, Schenectady, NY (US)

( * ) Notice: Subject to any disclaimer, the term of this patent is extended or adjusted under 35 U.S.C. 154(b) by 1016 days.

(21) Appl. No.: 15/225,299

(22) Filed: Aug. 1, 2016

(65) Prior Publication Data

US 2018/0030987 A1 Feb. 1, 2018

(51) Int. Cl.

| | |
|---|---|
| ***F01D 11/24*** | (2006.01) |
| ***F04D 29/52*** | (2006.01) |
| ***F04D 27/02*** | (2006.01) |
| ***F04D 29/16*** | (2006.01) |

(52) U.S. Cl.

CPC ..... *F01D 11/24* (2013.01); *F04D 27/0246* (2013.01); *F04D 29/164* (2013.01); *F04D 29/526* (2013.01)

(58) Field of Classification Search

CPC ..... F01D 11/14; F01D 11/20; F01D 11/24; F04D 29/526

See application file for complete search history.

(56) References Cited

U.S. PATENT DOCUMENTS

| | | | | |
|---|---|---|---|---|
| 3,938,328 | A | 2/1976 | Klees | |
| 4,762,462 | A * | 8/1988 | Lardellier | F01D 9/041 415/139 |
| 5,012,420 | A * | 4/1991 | Walker | F01D 11/24 415/1 |
| 5,281,085 | A * | 1/1994 | Lenahan | F01D 11/24 415/116 |
| 5,385,013 | A * | 1/1995 | Barron | F01D 25/14 415/116 |
| 6,202,403 | B1 * | 3/2001 | Laborie | B64D 33/08 60/39.83 |

(Continued)

FOREIGN PATENT DOCUMENTS

EP 2824283 A2 1/2015

*Primary Examiner* — Moshe Wilensky
*Assistant Examiner* — Christopher R Legendre
(74) *Attorney, Agent, or Firm* — Dority & Manning, P.A.

(57) ABSTRACT

The rotatable machine includes a compressor and an inner annular casing circumscribing at least a portion of the compressor. The inner annular casing includes an outer surface in a radial direction, an upper portion in a vertical direction, and a lower portion in a vertical direction. The clearance control system includes a manifold system including at least one conduit extending circumferentially around the lower portion of the inner annular casing. The clearance control system includes a header system including at least one header extending circumferentially around only the lower portion of the inner annular casing. The at least one header configured to receive a flow of cooling fluid from the at least one conduit. The at least one header configured to channel the flow of cooling fluid to the lower portion of the outer surface of the inner annular casing.

19 Claims, 6 Drawing Sheets

(56) References Cited

U.S. PATENT DOCUMENTS

| | | | | |
|---|---|---|---|---|
| 6,487,491 | B1 | 11/2002 | Karpman et al. | |
| 8,082,727 | B2 | 12/2011 | Roberge | |
| 8,127,528 | B2 | 3/2012 | Roberge | |
| 8,920,109 | B2 * | 12/2014 | Tham | F02C 9/16 415/108 |
| 8,935,923 | B2 | 1/2015 | Kupratis | |
| 9,200,529 | B2 | 12/2015 | Buchal et al. | |
| 9,200,530 | B2 | 12/2015 | McCaffrey | |
| 9,206,744 | B2 | 12/2015 | Maldonado et al. | |
| 2014/0248119 | A1 | 9/2014 | Jen et al. | |
| 2015/0337675 | A1 | 11/2015 | Suciu et al. | |
| 2018/0030987 | A1 * | 2/2018 | Clarke | F04D 29/526 |

* cited by examiner

METHOD AND APPARATUS FOR ACTIVE CLEARANCE CONTROL ON GAS TURBINE ENGINES

BACKGROUND

The field of the disclosure relates generally to gas turbine engines and, more particularly, to a method and apparatus for active clearance control in gas turbine engines.

During operation, at least some known aircraft engine components generate heat, which affect their performance. Such components include, for example, but are not limited to, a high pressure compressor, which includes a rotor disk, compressor blades coupled to the rotor disk, and a casing housing the high-pressure compressor, and the combustion of gases in the combustion chamber. Differential thermal expansion of the disk, compressor blades, and compressor casing change the clearance between the tips of the compressor blades and the inner surface of the compressor casing. Engine inefficiencies occur when the clearance between the compressor blade tips and the inner surface of the compressor casing is large, thereby facilitating decreased compressor pressure rise capability and decreased stability, eventually leading to higher fuel consumption.

In addition, some known active mechanical control methods use linkages and actuation to control the clearance between the compressor blade tips and the inner compressor casing. Segmented shrouds attached to a unison ring and actuators individually control the positioning of each shroud. The active mechanical control method has a quick response rate, but the additional equipment required for the active mechanical control method adds weight to the aircraft.

BRIEF DESCRIPTION

In one aspect, a clearance control system for a rotatable machine is provided. The rotatable machine includes a compressor and an inner annular casing circumscribing at least a portion of the compressor. The inner annular casing includes a radial outer surface, a vertical upper portion, and a vertical lower portion. The clearance control system includes a manifold system including at least one conduit extending circumferentially around the vertical lower portion of the inner annular casing. The clearance control system includes a header system including at least one header extending circumferentially around the vertical lower portion of the inner annular casing. The at least one header configured to receive a flow of cooling fluid from the at least one conduit. The at least one header configured to channel the flow of cooling fluid to the vertical lower portion of the radial outer surface of the inner annular casing. The header system does not include a header extending circumferentially around the radial outer surface of the vertical upper portion of the inner annular casing.

In another aspect, a method of controlling a clearance between a tip of a plurality of compressor blades and an inner annular casing is provided. The inner annular casing includes a radial outer surface including a vertical upper portion and a vertical lower portion. The method includes channeling at least one flow of cooling fluid to a manifold system disposed on the vertical lower portion of the radial outer surface of the inner annular casing. The method also includes channeling the at least one flow of cooling fluid from the manifold system to the header system disposed on the vertical lower portion of the radial outer surface of the inner annular casing. The method further includes channeling the at least one flow of cooling fluid from the header system to the vertical lower portion of the radial outer surface of the inner annular casing. The header system does not include a header extending circumferentially around the radial outer surface of the vertical upper portion of the inner annular casing.

In yet another aspect, a rotatable machine is provided. The rotatable machine includes a compressor including an inner annular casing. The inner annular casing includes a radial outer surface, a vertical upper portion, and a vertical lower portion. The clearance control system includes a manifold system including at least one conduit extending circumferentially around the vertical lower portion of the inner annular casing. The clearance control system includes a header system including at least one header extending circumferentially around the vertical lower portion of the inner annular casing. The at least one header configured to receive a flow of cooling fluid from the at least one conduit. The at least one header configured to channel the flow of cooling fluid to the vertical lower portion of the radial outer surface of the inner annular casing. The header system does not include a header extending circumferentially around the radial outer surface of the vertical upper portion of the inner annular casing.

DRAWINGS

These and other features, aspects, and advantages of the present disclosure will become better understood when the following detailed description is read with reference to the accompanying drawings in which like characters represent like parts throughout the drawings, wherein:

FIG. 1 is a perspective view of an aircraft.

FIG. 2 is a schematic view of a gas turbine engine.

FIG. 3 is a partial schematic view of the gas turbine engine shown in FIG. 2.

FIG. 4 is a schematic view of another embodiment of the gas turbine engine.

FIG. 5 is a perspective view of a header system.

FIG. 6 is a schematic view of another embodiment of the gas turbine engine.

Figure 1:
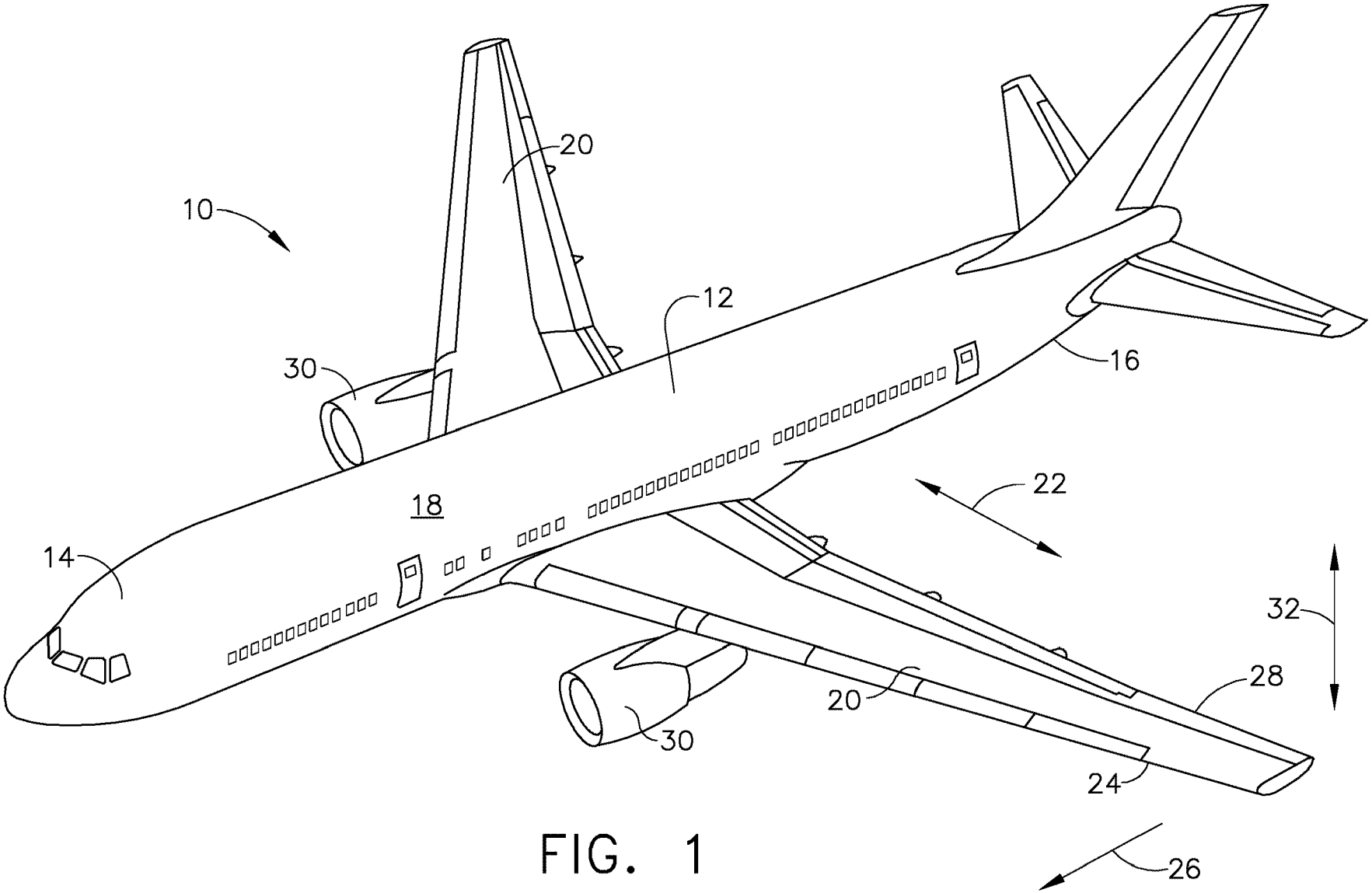
FIGS. 1-6 show example embodiments of the method and apparatus described herein.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the terms "processor" and "computer", and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and/or a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Embodiments of the active clearance control system described herein control the clearance between the inner annular casing of, for example, a high pressure compressor in a rotatable machine, e.g. an aircraft engine, and high pressure compressor blade tips. The active clearance control system includes an air inlet, a manifold system, a controller, and a header system. The manifold system and the header system are located on the vertical lower portion of the high pressure compressor. The air inlet directs fan air from the bypass airflow passage to the manifold system. The manifold system directs air to the header system. An air valve and a controller control the volume of air directed to the manifold system. The header system directs air to the inner annular casing of the high pressure compressor by directing air to the vertical lower portion of the radial outer surface of the inner annular casing. Cooling the vertical lower portion inner annular casing of the high pressure compressor reduces thermal expansion of the lower part of the casing and decreases the clearance between the inner annular casing of a high pressure compressor in an aircraft engine and high pressure compressor blade tips. Cooling only the bottom part of the compressor casing permits to reduce the clearance on the lower part of the engine, which counteracts the increased clearance caused by the engine thrust (phenomenon known as engine backbone bending). Additionally, a separate active clearance control system may be added to the vertical upper portion of the radial outer surface of the inner annular casing to independently cool the vertical upper portion of the radial outer surface of the inner annular casing. Independently cooling the vertical upper and lower portions optimizes the cooling capability of the active clearance controls systems to reduce fuel consumption.

The active clearance control system described herein offers advantages over known methods of controlling clearances in aircraft engines. More specifically, delivering bypass airflow passage air directly to the vertical lower portion or vertical upper portion of the surface of the HP compressor reduces thermal expansion of the HP compressor casing. Additionally, delivering bypass airflow passage air directly to the vertical lower or upper portion of the surface of the HP compressor rather than using actuators and linkages reduces the weight of the rotatable machine. Additionally, cooling only the vertical lower or upper portion of the HP compressor, rather than cooling the entire circumference of the HP compressor, reduces the weight of the rotatable machine. Finally, independently cooling the vertical upper and lower portions optimizes the cooling capability of the active clearance controls systems to reduce fuel consumption.

FIG. 1 is a perspective view of an aircraft 10. In the example embodiment, aircraft 10 includes a fuselage 12 that includes a nose 14, a tail 16, and a hollow, elongate body 18 extending therebetween. Aircraft 10 also includes a wing 20 extending away from fuselage 12 in a lateral direction 22. Wing 20 includes a forward leading edge 24 in a direction 26 of motion of aircraft 10 during normal flight and an aft trailing edge 28 on an opposing edge of wing 20. Aircraft 10 further includes at least one engine 30 configured to drive a bladed rotatable member or fan to generate thrust. Engine 30 is coupled to at least one of wing 20 and fuselage 12, for example, in a pusher configuration (not shown) proximate tail 16. In the exemplary embodiment, engine 30 is coupled to wing 20 below wing 20 in a vertical direction 32. Vertical direction 32 is defined relative to the direction aircraft 10 is oriented when stationary on the ground. Down, vertical lower, or below refers to the side of aircraft 10 facing the ground when aircraft 10 has weight on wheels. Up, vertical upper, or above refers to the side of aircraft 10 opposite down, vertical lower, or below. Engine 30 is not limited to wing-mount engines as depicted in FIG. 1. Engine 30 may also include engines installed over wing 20, engines installed to fuselage 12, or engines installed within fuselage 12.

Figure 2:
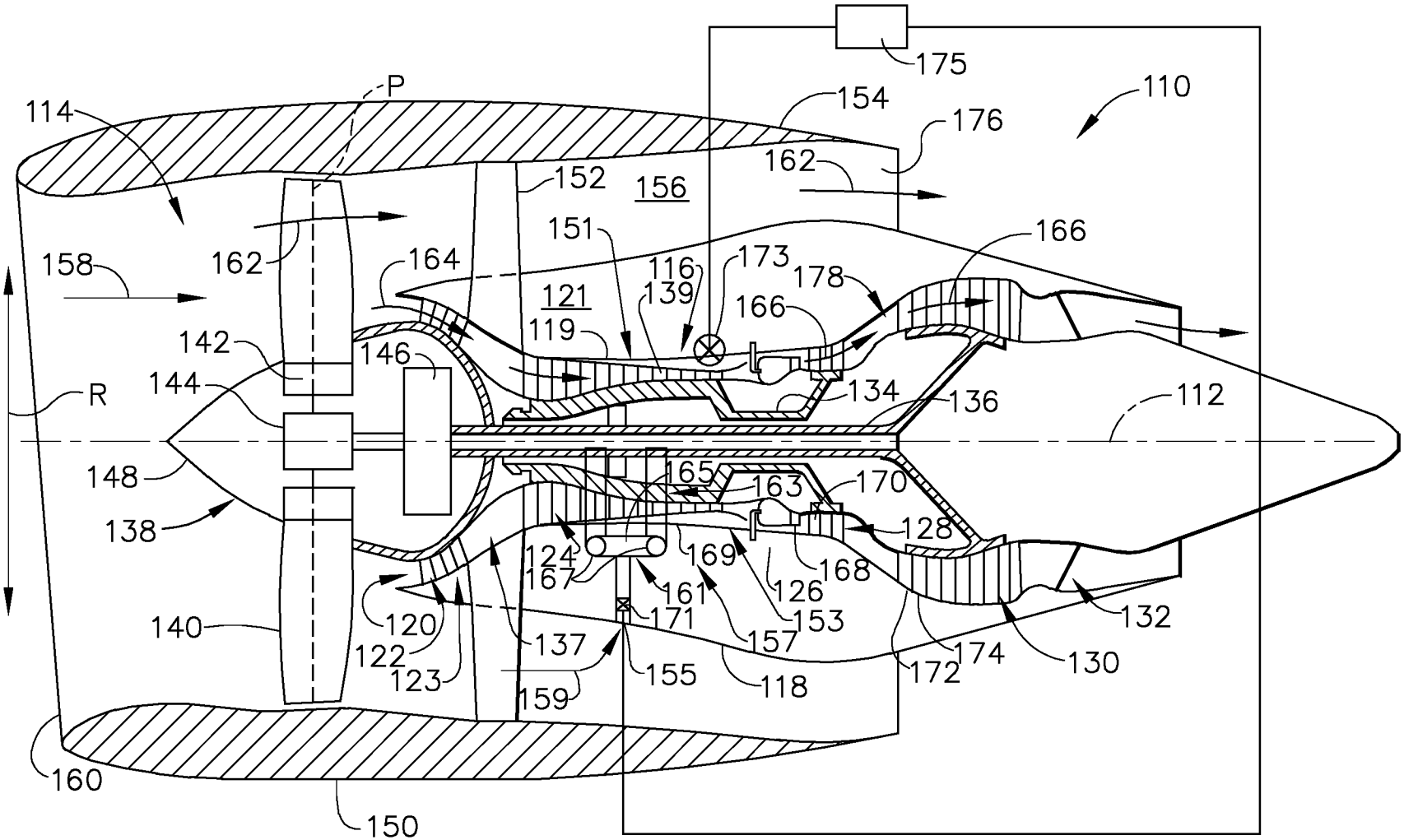
Figure 3:
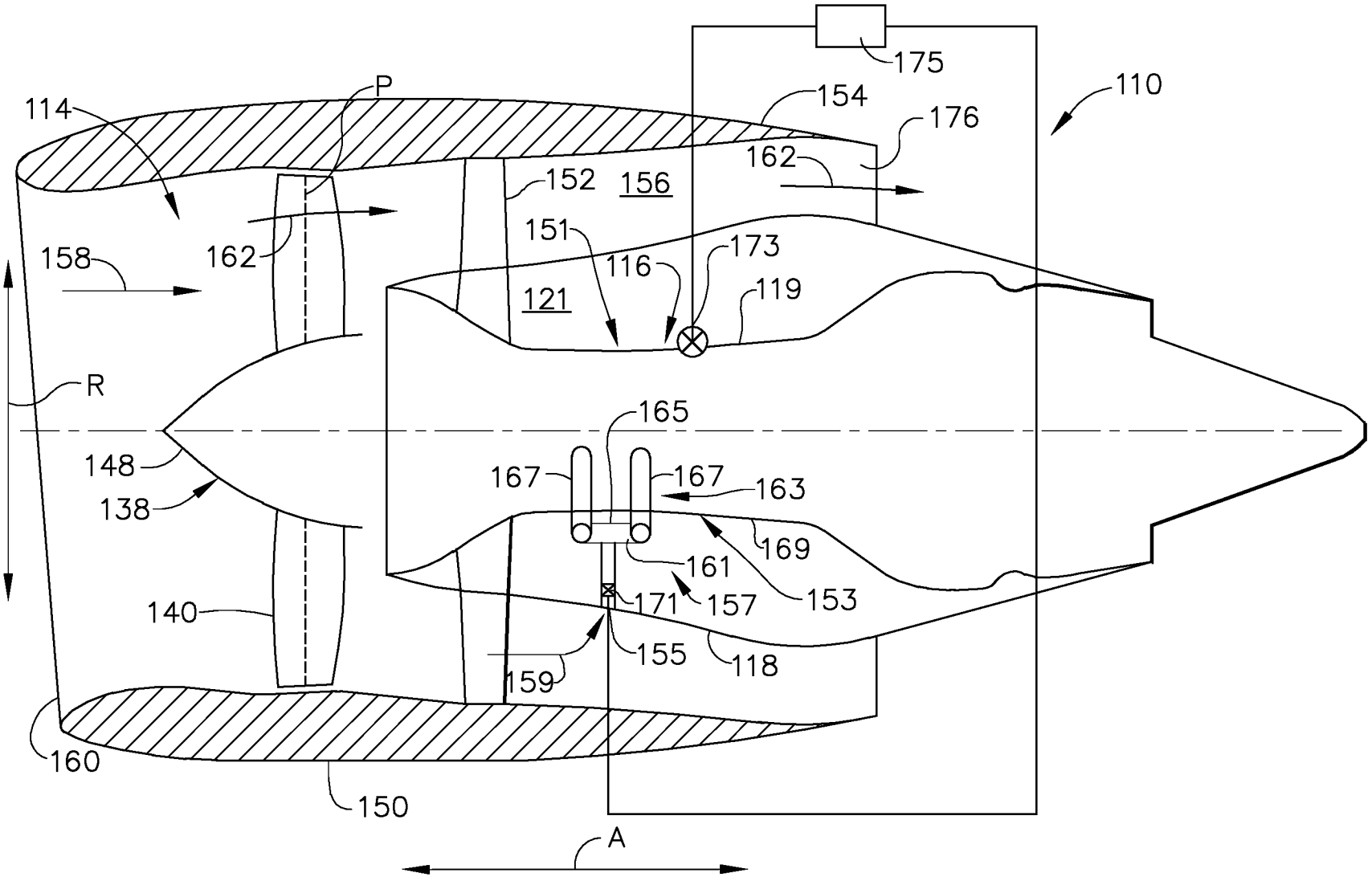

FIG. 2 is a schematic cross-sectional view of a gas turbine engine 110 in accordance with an exemplary embodiment of the present disclosure. FIG. 3 is a partial schematic cross-sectional view of gas turbine engine 110 in accordance with an exemplary embodiment of the present disclosure. In the exemplary embodiment, gas turbine engine 110 is a high-bypass turbofan jet engine 110, referred to herein as "turbofan engine 110." Gas turbine engine 110 is not limited to high bypass turbofan engines. Gas turbine engine 110 may be any type of engine which enables the active clearance control systems to operate as described herein, including, but not limited to, industrial engines and marine engines. As shown in FIG. 2, turbofan engine 110 defines an axial direction A (extending parallel to a longitudinal centerline 112 provided for reference) and a radial direction R. In general, turbofan engine 110 includes a fan section 114 and a core turbine engine 116 disposed downstream from fan section 114.

Exemplary core turbine engine 116 depicted generally includes a substantially tubular outer casing 118 that defines an annular inlet 120. Outer casing 118 and an inner casing 119 encases, in serial flow relationship, a compressor section 123 including a booster or low pressure (LP) compressor 122 and a high pressure (HP) compressor 124; a combustion section 126; a turbine section including a high pressure (HP) turbine 128 and a low pressure (LP) turbine 130; and a jet exhaust nozzle section 132. The volume between outer casing 118 and inner casing 119 forms a plurality of cavities 121. A high pressure (HP) shaft or spool 134 drivingly connects HP turbine 128 to HP compressor 124. A low pressure (LP) shaft or spool 136 drivingly connects LP turbine 130 to LP compressor 122. Compressor section 123, combustion section 126, turbine section, and nozzle section 132 together define a core air flowpath 137. HP compressor includes a plurality of HP compressor blades 139 configured to increase the pressure of a flow of air.

As shown in FIG. 2, fan section 114 includes a variable pitch fan 138 having a plurality of fan blades 140 coupled to a disk 142 in a spaced apart manner. As depicted, fan blades 140 extend outwardly from disk 142 generally along radial direction R. Each fan blade 140 is rotatable relative to disk 142 about a pitch axis P by virtue of fan blades 140 being operatively coupled to a suitable pitch change mechanism 144 configured to collectively vary the pitch of fan blades 140 in unison. Fan blades 140, disk 142, and pitch change mechanism 144 are together rotatable about longitudinal axis 112 by LP shaft 136 across a power gear box 146. Power gear box 146 includes a plurality of gears for adjusting the rotational speed of fan 138 relative to LP shaft 136 to a more efficient rotational fan speed. Fan 138 is not limited to a variable pitch fan as depicted in FIG. 2. Fan 138 may also include fixed pitch fans.

Also, in the exemplary embodiment, disk 142 is covered by rotatable front hub 148 aerodynamically contoured to promote an airflow through plurality of fan blades 140. Additionally, exemplary fan section 114 includes an annular fan casing or outer nacelle 150 that circumferentially surrounds fan 138 and/or at least a portion of core turbine engine 116. Nacelle 150 is configured to be supported relative to core turbine engine 116 by a plurality of circumferentially-spaced outlet guide vanes 152. A downstream section 154 of nacelle 150 extends over an outer portion of core turbine engine 116 so as to define a bypass airflow passage 156 therebetween.

Inner casing 119 includes a vertical upper portion 151 and a vertical lower portion 153. Vertical lower portion 153 refers to the side of core turbine engine 116 facing the ground when aircraft 10 has weight on wheels. Vertical upper portion 151 refers to the side of aircraft 10 opposite vertical lower portion 153. Vertical upper portion 151 is bolted to vertical lower portion 153. Typically, vertical upper portion 151 is bolted to vertical lower portion 153 at the 3 and 9 o'clock circumferential positions. This arrangement permits the compressor blades to be changed without removing the entire engine.

Figure 4:
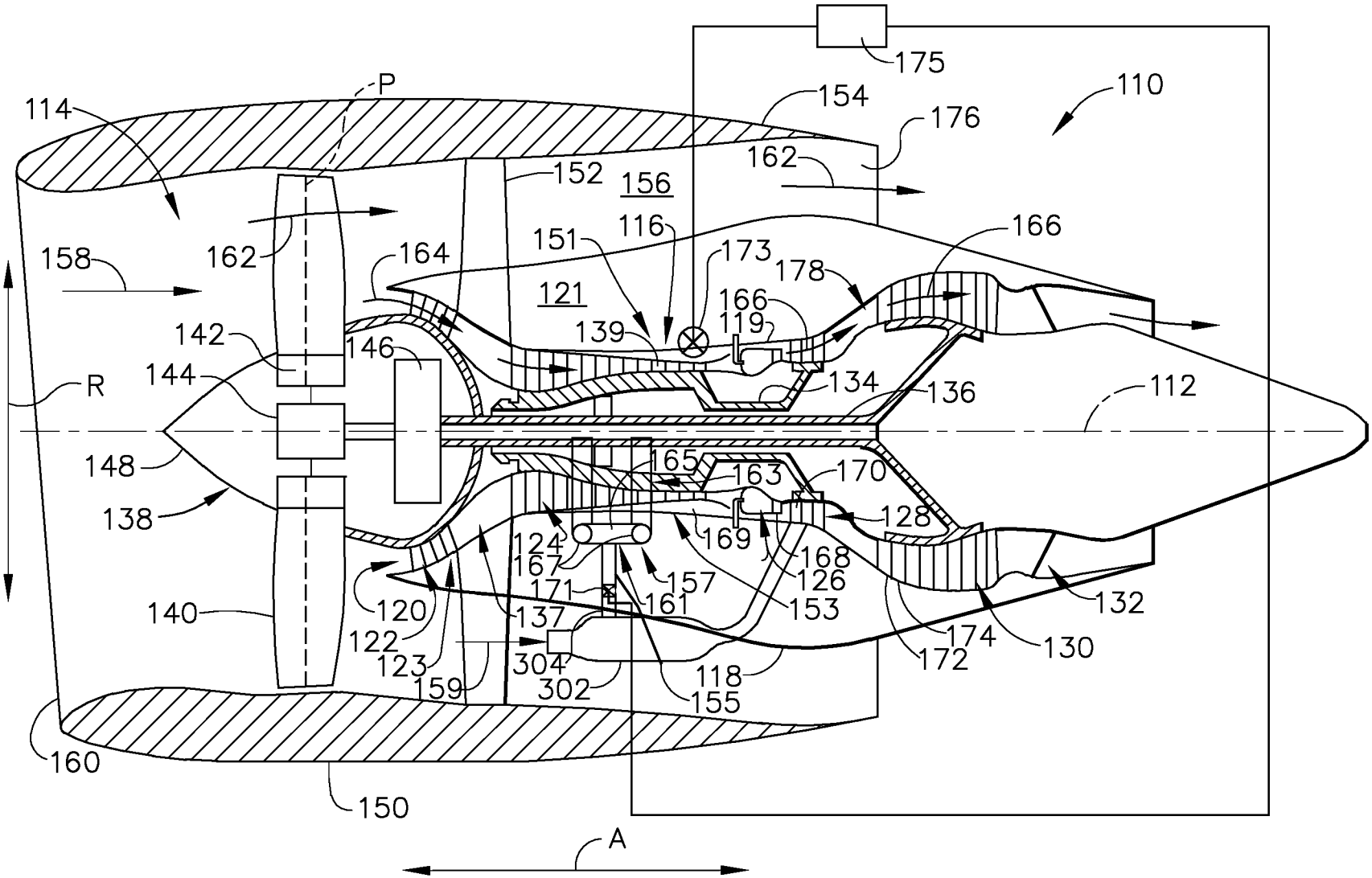

A shown in FIGS. 2-4, a plurality of active clearance control systems 157 are disposed within cavities 121 and partially circumscribe a vertical lower portion 153 of core turbine engine 116. In the exemplary embodiment, an air conduit 155 is coupled in flow communication with active clearance control system 157 and extends into bypass airflow passage 156. Air conduit 155 is configured to channel air from bypass airflow passage 156 to active clearance control system 157. Active clearance control system 157 includes a manifold system 161 and a header system 163. Manifold system 161 includes a plurality of manifolds 165 coupled in flow communication with air conduit 155 and header system 163. Manifold system 161 is configured to channel air from air conduit 155 to header system 163. Header system 163 includes a plurality of headers 167 configured to channel air to a radial outer surface 169 of inner casing 119. In the exemplary embodiment, air conduit 155 includes a control valve 171 configured to control the flow of air to manifold system 161. In another embodiment, a clearance sensor 173 measures the clearance between HP compressor blades 139 and inner casing 119. A controller 175 controls control valve 171 based on the clearance measured by clearance sensor 173.

During operation of turbofan engine 110, a volume of air 158 enters turbofan engine 110 through an associated inlet 160 of nacelle 150 and/or fan section 114. As volume of air 158 passes across fan blades 140, a first portion of air 158 as indicated by arrows 162 is directed or routed into bypass airflow passage 156 and a second portion of air 158 as indicated by arrow 164 is directed or routed into core air flowpath 137, or more specifically into LP compressor 122. The ratio between first portion of air 162 and second portion of air 164 is commonly known as a bypass ratio. The pressure of second portion of air 164 is then increased as it is routed through HP compressor 124 and into combustion section 126, where it is mixed with fuel and burned to provide combustion gases 166.

A portion of first portion of air 162 as indicated by arrows 159 is directed into air conduit 155. Air conduit 155 channels portion of air 159 to manifold system 161 which channels portion of air 159 to header system 163. Header system 163 channels portion of air 159 to radial outer surface 169 of inner casing 119. Portion of air 159 is cooler than radial outer surface 169 of inner casing 119 and reduces the temperature of radial outer surface 169 of inner casing 119. Reducing the temperature of radial outer surface 169 of inner casing 119 reduces thermal expansion of inner casing 119 and improves the efficiency of HP compressor 124.

Combustion gases 166 are routed through HP turbine 128 where a portion of thermal and/or kinetic energy from combustion gases 166 is extracted via sequential stages of HP turbine stator vanes 168 that are coupled to outer casing 118 and HP turbine rotor blades 170 that are coupled to HP shaft or spool 134, thus causing HP shaft or spool 134 to rotate, thereby supporting operation of HP compressor 124. Combustion gases 166 are then routed through LP turbine 130 where a second portion of thermal and kinetic energy is extracted from combustion gases 166 via sequential stages of LP turbine stator vanes 172 that are coupled to outer casing 118 and LP turbine rotor blades 174 that are coupled to LP shaft or spool 136, thus causing LP shaft or spool 136 to rotate, thereby supporting operation of LP compressor 122 and/or rotation of fan 138.

Combustion gases 166 are subsequently routed through jet exhaust nozzle section 132 of core turbine engine 116 to provide propulsive thrust. Simultaneously, the pressure of first portion of air 162 is substantially increased as first portion of air 162 is routed through bypass airflow passage 156 before it is exhausted from a fan nozzle exhaust section 176 of turbofan engine 110, also providing propulsive thrust. HP turbine 128, LP turbine 130, and jet exhaust nozzle section 132 at least partially define a hot gas path 178 for routing combustion gases 166 through core turbine engine 116.

Exemplary turbofan engine 110 depicted in FIG. 2 is by way of example only, and that in other embodiments, turbofan engine 110 may have any other suitable configuration. It should also be appreciated, that in still other embodiments, aspects of the present disclosure may be incorporated into any other suitable gas turbine engine. For example, in other embodiments, aspects of the present disclosure may be incorporated into, e.g., a turboprop engine.

FIG. 4 is a schematic cross-sectional view of a gas turbine engine 110 in accordance with an exemplary embodiment of the present disclosure. A core compartment cooling system 302 extends into bypass airflow passage 156 and channels air to gas turbine engine 110 to cool cavity 121. Active clearance control systems 157 are disposed within cavities 121 and partially circumscribe vertical lower portion 153 of core turbine engine 116. In the exemplary embodiment, an offtake 304 of core compartment cooling system 302 is coupled in flow communication with active clearance control system 157 and core compartment cooling system 302. Offtake 304 is configured to channel air from core compartment cooling system 302 to active clearance control system 157. Active clearance control system 157 includes a manifold system 161 and a header system 163. Manifold system 161 includes a plurality of manifolds 165 coupled in flow communication with air conduit 155 and header system 163. Manifold system 161 is configured to channel air from offtake 304 to header system 163. Header system 163 includes a plurality of headers 167 configured to channel air to a radial outer surface 169 of inner casing 119. In the exemplary embodiment, offtake 304 includes a control valve 171 configured to control the flow of air to manifold system 161. In another embodiment, a clearance sensor 173 measures the clearance between HP compressor blades 139 and inner casing 119. A controller 175 controls control valve 171 based on the clearance measured by clearance sensor 173.

A portion of first portion of air 162 as indicated by arrows 159 is directed into core compartment cooling system 302. Core compartment cooling system 302 channels air to offtake 304. Offtake 304 channels portion of air 159 to manifold system 161 which channels portion of air 159 to header system 163. Header system 163 channels portion of air 159 to radial outer surface 169 of inner casing 119. Portion of air 159 is cooler than radial outer surface 169 of inner casing 119 and reduces the temperature of radial outer surface 169 of inner casing 119. Reducing the temperature of radial outer surface 169 of inner casing 119 reduces thermal expansion of inner casing 119 and improves the efficiency of HP compressor 124. Cooling only vertical lower portion 153 of HP compressor 124, rather than cooling the entire circumference of HP compressor 124, reduces the weight of gas turbine engine 110.

Figure 5:
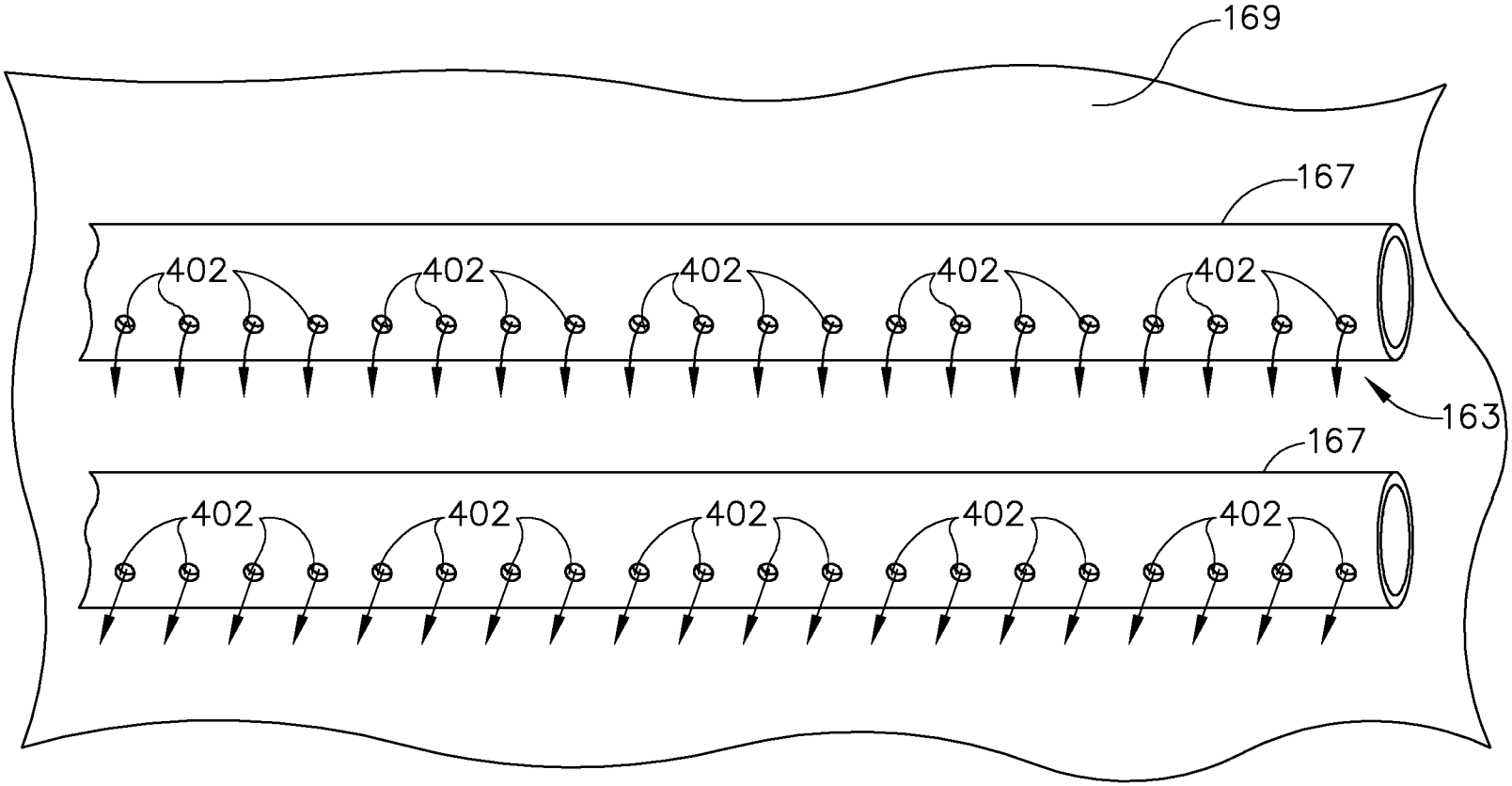

FIG. 5 is a perspective view of header system 163. In the exemplary embodiment, header system 163 includes two headers 167. Header system 163 can include any number of headers 167 that enable header system to function as described herein. Each header 167 includes a plurality of holes 402 configured to direct air to radial outer surface 169 of inner casing 119. During operation, manifold system 161 channels portion of air 159 to header system 163 which channels portion of air 159 to headers 167. Headers 167 channels portion of air 159 to holes 402 which channels portion of air 159 to radial outer surface 169 of inner casing 119. Portion of air 159 is cooler than radial outer surface 169 of inner casing 119 and reduces the temperature of radial outer surface 169 of inner casing 119. Reducing the temperature of radial outer surface 169 of inner casing 119 reduces thermal expansion of inner casing 119 and improves the efficiency of HP compressor 124.

Figure 6:
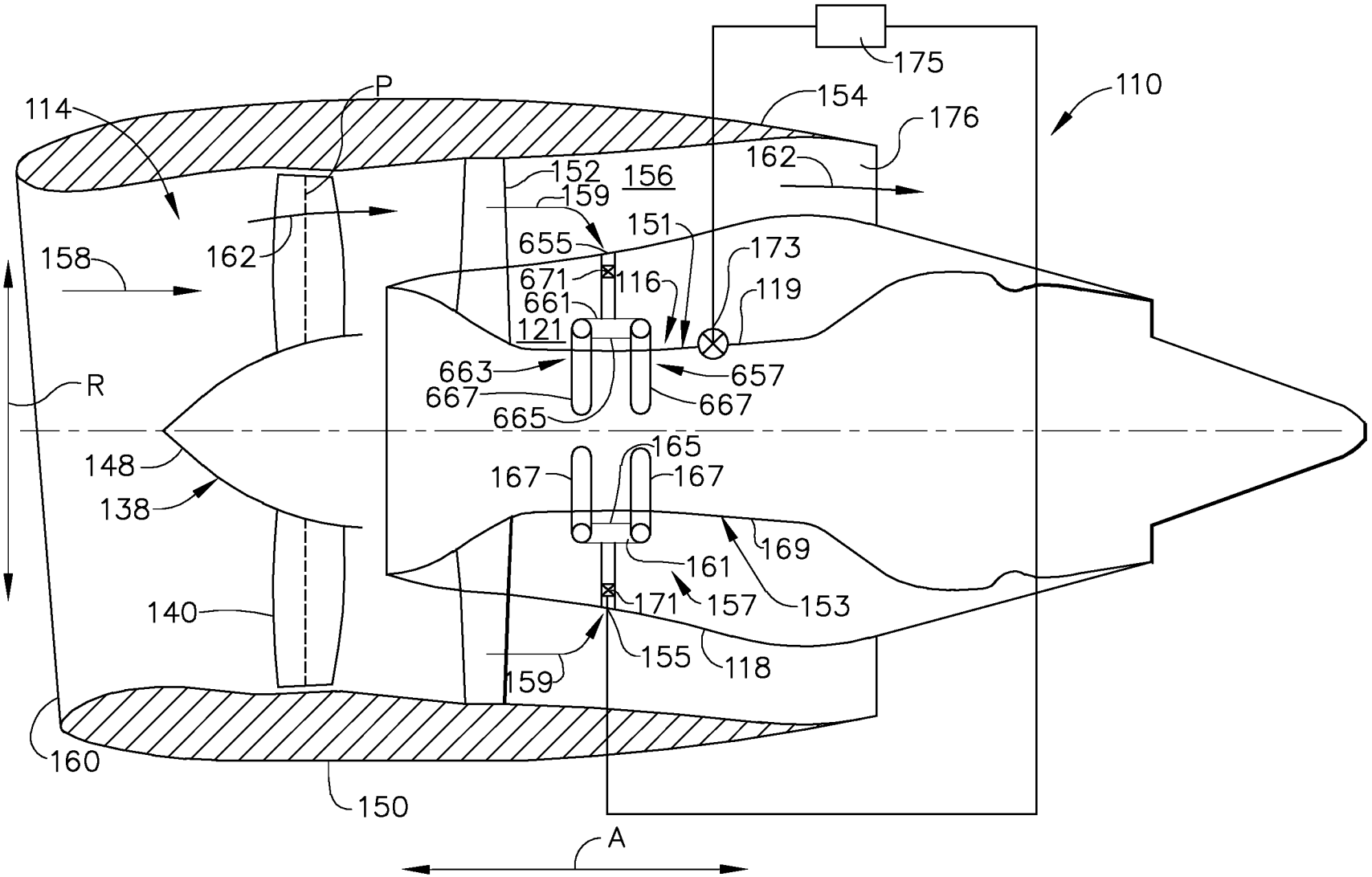

FIG. 6 is a schematic cross-sectional view of a gas turbine engine 110 in accordance with an exemplary embodiment of the present disclosure. Gas turbine engine 110 includes at least one second active clearance control systems 657 in addition to active clearance control systems 157 (previously described). Second active clearance control systems 657 are disposed within cavities 121 and partially circumscribe a vertical upper portion 151 of inner casing 119. In the exemplary embodiment, an air conduit 655 is coupled in flow communication with active clearance control system 157. Air conduit 655 is configured to channel air from bypass airflow passage 156 to second active clearance control system 657. Second active clearance control system 657 includes a manifold system 661 and a header system 663. Manifold system 661 includes a plurality of manifolds 665 coupled in flow communication with air conduit 655 and header system 663. Manifold system 661 is configured to channel air from air conduit 655 to header system 663. Header system 663 includes a plurality of headers 667 configured to channel air to a radial outer surface 169 of inner casing 119. In the exemplary embodiment, air conduit 655 includes a control valve 671 configured to control the flow of air to manifold system 661.

During operation, a portion of first portion of air 162 as indicated by arrows 159 is directed into air conduit 655. Air conduit 655 channels portion of air 159 to manifold system 661 which channels portion of air 159 to header system 663. Header system 663 channels portion of air 159 to radial outer surface 169 of inner casing 119. Portion of air 159 is cooler than radial outer surface 169 of inner casing 119 and reduces the temperature of radial outer surface 169 of inner casing 119. Reducing the temperature of radial outer surface 169 of inner casing 119 reduces thermal expansion of inner casing 119 and improves the efficiency of HP compressor 124.

Active clearance control system 157 and second active clearance control system 657 independently cool radial outer surface 169 of inner casing 119. Independently cooling the vertical upper and lower portions 151 and 153 optimizes the cooling capability of the active clearance controls systems 157 and 657 to reduce fuel consumption of gas turbine engine 110.

In the exemplary embodiment, active clearance control system 157 and second active clearance control system 657 direct air from bypass airflow passage 156 to radial outer surface 169 of inner casing 119. In another embodiment, active clearance control system 157 and second active clearance control system 657 direct compressor bleed air to radial outer surface 169 of inner casing 119.

In the exemplary embodiment, active clearance control system 157 and second active clearance control system 657 are controlled by control valves 171 and 671. In another embodiment, active clearance control system 157 and second active clearance control system 657 may be controlled by a mechanical device similar to a governor which detect the speed of gas turbine engine 110 and adjust the flow of air to radial outer surface 169 of inner casing 119 according to the detected speed.

The above-described active clearance control system provides an efficient method for controlling the blade clearance in a rotatable machine. Specifically, delivering bypass airflow passage air directly to the vertical lower portion of the surface of the HP compressor reduces thermal expansion of the HP compressor casing. Additionally, delivering bypass airflow passage air directly to the vertical lower portion of the surface of the HP compressor rather than using actuators and linkages reduces the weight of the rotatable machine. Additionally, cooling only the vertical lower portion of the HP compressor, rather than cooling the entire circumference of the HP compressor, reduces the weight of the rotatable machine. Finally, independently cooling the vertical upper and lower portions optimizes the cooling capability of the active clearance controls systems to reduce fuel consumption.

An exemplary technical effect of the methods, systems, and apparatus described herein includes at least one of: (a) decreasing the temperature on the inner annular casing of a rotatable machine; (b) decreasing the clearance between the HP compressor blade tips and the inner annular casing of a rotatable machine; (c) decreasing the weight of a rotatable machine; and (d) decreasing the weight of an aircraft.

Exemplary embodiments of the active clearance control system are described above in detail. The active clearance control system, and methods of operating such units and devices are not limited to the specific embodiments described herein, but rather, components of systems and/or steps of the methods may be utilized independently and separately from other components and/or steps described herein. For example, the methods may also be used in combination with other systems for controlling clearances, and are not limited to practice with only the systems and methods as described herein. Rather, the exemplary embodiment may be implemented and utilized in connection with many other machinery applications that require clearance control.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

Some embodiments involve the use of one or more electronic or computing devices. Such devices typically include a processor, processing device, or controller, such as a general purpose central processing unit (CPU), a graphics processing unit (GPU), a microcontroller, a reduced instruction set computer (RISC) processor, an application specific integrated circuit (ASIC), a programmable logic circuit (PLC), a field programmable gate array (FPGA), a digital signal processing (DSP) device, and/or any other circuit or processing device capable of executing the functions described herein. The methods described herein may be encoded as executable instructions embodied in a computer readable medium, including, without limitation, a storage device and/or a memory device. Such instructions, when executed by a processing device, cause the processing device to perform at least a portion of the methods described herein. The above examples are exemplary only, and thus are not intended to limit in any way the definition and/or meaning of the term processor and processing device.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A clearance control system for a rotatable machine, the rotatable machine including a compressor and an inner annular casing circumscribing at least a portion of the compressor, said inner annular casing including an upper portion in a vertical direction, and a lower portion in the vertical direction having an outer surface in a radial direction, and an outer annular casing that defines an inner boundary of a bypass airflow passage, said clearance control system comprising:

a manifold system comprising at least one conduit extending circumferentially around only said outer surface of said lower portion of said inner annular casing;

an air conduit comprising an opening that opens from a lower portion in the vertical direction of the outer annular casing configured to channel a flow of cooling fluid to the manifold system;

a header system comprising at least one header extending circumferentially around the lower portion of the inner annular casing, said at least one header configured to receive the flow of cooling fluid from said at least one conduit of the manifold system, said at least one header configured to channel said flow of cooling fluid to said outer surface of said lower portion of said inner annular casing; and a core compartment cooling system extending into the bypass airflow passage and comprising an offtake conduit configured to channel the flow of cooling fluid from the bypass airflow passage to the opening of the air conduit.

2. The clearance control system of claim 1, wherein the at least one header includes at least one hole to direct the flow of cooling fluid to the outer surface of the inner annular casing.

3. The clearance control system of claim 1, wherein the at least one header includes a plurality of holes to direct the flow of cooling fluid to the outer surface of the inner annular casing.

4. The clearance control system of claim 1, wherein said core compartment cooling system comprises a control valve configured to control said flow of cooling fluid to said air conduit.

5. The clearance control system of claim 1, wherein the upper portion of the inner annular casing is removably fixed to the lower portion of the inner annular casing.

6. The clearance control system of claim 1, wherein said air conduit comprises a control valve configured to control said flow of cooling fluid to said manifold system.

7. The clearance control system of claim 1, wherein the core compartment cooling system comprises a control valve controlled based on clearance measurements by a clearance sensor.

8. The clearance control system of claim 1, wherein said header system does not comprise a header extending circumferentially around an outer surface of said upper portion of said inner annular casing.

9. A method of controlling a clearance between a tip of at least one compressor blade and an inner annular casing, the inner annular casing including an upper portion in a vertical direction and a lower portion in the vertical direction having an outer surface in a radial direction, said method comprising:

channeling, via a core compartment cooling system extending into a bypass flow passage and comprising an offtake conduit, at least one flow of cooling fluid from a lower portion in the vertical direction of the bypass flow passage to an air conduit comprising an opening that opens from an outer annular casing that defines an inner boundary of the bypass flow passage;

channeling the at least one flow of cooling fluid from the air conduit to a manifold system disposed around the outer surface of the lower portion of the inner annular casing;

channeling the at least one flow of cooling fluid from the manifold system to a header system disposed around the outer surface of the lower portion of the inner annular casing; and channeling the at least one flow of cooling fluid from the header system to the outer surface of the lower portion of the inner annular casing.

10. The method of claim 9, wherein the header system includes a plurality of holes for channeling the at least one flow of cooling fluid to the outer surface of the lower portion of the inner annular casing.

11. The method of claim 9, wherein the core compartment cooling system comprises a control valve configured to control the at least one flow of cooling fluid.

12. The method of claim 9, wherein channeling the at least one flow of cooling fluid from the header system to the outer surface of the lower portion of the inner annular casing reduces thermal expansion of the inner annular casing.

13. The method of claim 9, wherein channeling the at least one flow of cooling fluid from the header system to the outer surface of the lower portion of the inner annular casing reduces a temperature of the inner annular casing.

14. The method of claim 9, wherein the header system does not include a header extending circumferentially around an outer surface of said upper portion of said inner annular casing.

15. A rotatable machine comprising:

a compressor comprising an inner annular casing comprising an upper portion in a vertical direction, and a lower portion in the vertical direction having an outer surface in a radial direction; and an outer annular casing defining an inner boundary of a bypass airflow passage;

a clearance control system comprising:

a first manifold system comprising at least one conduit extending circumferentially around only said outer surface of said lower portion of said inner annular casing;

an air conduit comprising an opening that opens from a lower portion in the vertical direction of the outer annular casing configured to channel a flow of cooling fluid to the first manifold system;

a first header system comprising at least one header extending circumferentially around the lower portion of the inner annular casing, said at least one header configured to receive a flow of cooling fluid from said at least one conduit of the first manifold system, said at least one first header configured to channel said flow of cooling fluid to said outer surface of said lower portion of said inner annular casing; and a core compartment cooling system extending into the bypass airflow passage and comprising an offtake conduit configured to channel the flow of cooling fluid from the bypass airflow passage to the opening of the air conduit.

16. The rotatable machine of claim 15, wherein the at least one header includes a plurality of holes to direct the flow of cooling fluid to the outer surface of the lower portion of the inner annular casing.

17. The rotatable machine of claim 15, wherein said core compartment cooling system comprises a control valve configured to control said flow of cooling fluid to said air conduit.

18. The rotatable machine of claim 15, wherein the clearance control system comprises:

a second manifold system comprising at least one second conduit extending circumferentially around only an outer surface of said upper portion of said inner annular casing; and a second header system comprising at least one second header extending circumferentially around the upper portion of the inner annular casing, said at least one second header configured to receive a flow of cooling fluid from said at least one second conduit, said at least one second header configured to channel said flow of cooling fluid to said outer surface of said upper portion of said inner annular casing.

19. The rotatable machine of claim 18, wherein the second manifold system and the second header system are controlled independently of the first manifold system and the first header system.

* * * * *